US005677657A

United States Patent [19]

Bagalini

[11] Patent Number: 5,677,657

[45] Date of Patent: Oct. 14, 1997

[54] CIRCUIT BREAKER

[75] Inventor: Dante Bagalini, Johannesburg, South Africa

[73] Assignee: Circuit Breaker Industries Limited, Gauteng, South Africa

[21] Appl. No.: 600,680

[22] Filed: Feb. 13, 1996

[30] Foreign Application Priority Data

Feb. 20, 1995 [ZA] South Africa ..... 95/1389

[51] Int. Cl.[6] ..... H01H 9/00

[52] U.S. Cl. ..... 335/172; 335/59; 335/177

[58] Field of Search ..... 335/59, 60, 61, 335/62, 63, 67, 236, 239, 240, 258, 259, 260, 177, 178, 179, 172, 167–171, 176

[56] References Cited

U.S. PATENT DOCUMENTS 3,071,664 1/1963 Priesemuth ..... 335/61
4,504,807 3/1985 Nar ..... 335/61

*Primary Examiner*—Lincoln Donovan
*Attorney, Agent, or Firm*—Ladas & Parry

[57] ABSTRACT

An electro-magnetic operating device 10 for a circuit breaker includes a coil 12 defining a cavity 14. A stator frame 20 which includes a pole piece 18 is arranged about the coil 12. A tube, which is closed off at one end by an end wall and at an opposed end by the pole piece 18 is arranged in the cavity 14. The tube 24 carries a core 22 therein. The plunger 22 is urged away from the pole piece 18 by a coil spring 28 arranged in the tube 26. The spring 28 is selected so that, when a load current of 100% is carried in the coil 12, the electro-magnetic force imparted to the core 18 exceeds the spring force imparted by the spring 28 to the core 22.

7 Claims, 2 Drawing Sheets

CIRCUIT BREAKER

FIELD OF THE INVENTION

This invention relates to a circuit breaker. More particularly, the invention relates to an electro-magnetic operating device for a circuit breaker and to a circuit breaker including such device. The invention is intended particularly, but not necessarily exclusively, for use in the protection of electrical motors.

Those skilled in the art will appreciate that the electrical load of a motor is characterised by a starting current and a running current. The starting or run-up current averages about six times the full load current of the motor but the peak of the first half cycle, the so-called "inrush" current, can reach a value of almost twenty times the motor RMS rated current.

SUMMARY OF THE INVENTION

According to the invention, there is provided an electro-magnetic operating device for a circuit breaker, the device including a coil which defines a cavity therein;

a magnetic path defining means arranged at least partially about the coil, the magnetic path defining means including a pole piece;

a displaceable element arranged within the cavity, the displaceable element being displaceable between a first position, spaced from the pole piece, and a second position, abutting, or in proximity to, the pole piece; and an urging means for urging the displaceable element to its first position, the urging means being selected, so that, at a load current of 100% of an item of electrical equipment connected to the circuit breaker, the urging means balances an electro-magnetic force applied to the displaceable element to hold the displaceable element at a position intermediate its first position and its second position.

It will be appreciated that the load current of the item of electrical equipment, which, as indicated above will normally be an electric motor, is carried by the coil of the circuit breaker. The load current generates magnetic flux in the magnetic path defining means which imparts the electro-magnetic force to the displaceable element.

The displaceable element may comprise a core or plunger. Preferably, the core is slidably mounted in a tube or canister, one end of the tube being closed off by an end wall and an opposed end of the tube being closed off, in a hermetic manner, by the pole piece.

To cater for a time-delay tripping of the circuit breaker, the core may be displaceable in a damped manner within the tube between its first position and its second position. Thus, a damping fluid of a predetermined viscosity may be contained within the tube for damping sliding movement of the core.

The urging means may comprise a coil spring, one end of the spring abutting the pole piece and an opposed end of the spring abutting against a predetermined formation of the core. The core may have a region of reduced cross-section to define a shoulder against which said other end of the spring abuts.

A spring force and a spring rate of the spring may match the electro-magnetic force applied to the core when the coil carries 100% of load current to hold the core in equilibrium intermediate its first position and its second position.

It will be appreciated that, at load currents of less than 100%, the core remains in its first position and at load current exceeding 100%, the core will move towards its second position from its intermediate position.

In selecting or designing the spring, the force on the core as a function of its gap is calculated for various load currents and plotted on a linear scale. The gap is the spacing between the core and the pole piece. The spring characteristic of the spring is drawn as a line tangential to the core electro-magnetic force corresponding to an operating current of 110% of load current. It will be appreciated that, when the coil carries current, the core has a tendency to be pulled towards the pole piece, thereby reducing the gap between the core and the pole piece. This has the effect of reducing the delayed tripping time and the instantaneous tripping time.

The invention extends to a circuit breaker which includes an electro-magnetic operating device as described above.

The invention is now described by way of example with reference to the accompanying diagrammatic drawings.

DETAILED DESCRIPTION OF THE DRAWINGS

Figure 1:
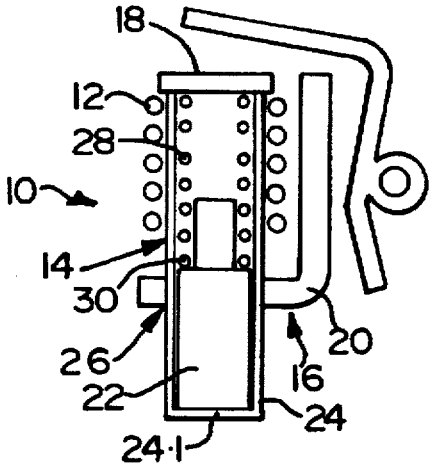
FIG. 1 shows a schematic representation of an electro-magnetic operating device, in accordance with the invention, for a circuit breaker, with a coil of the device carrying a current less than 100% of a load current.
Figure 2:
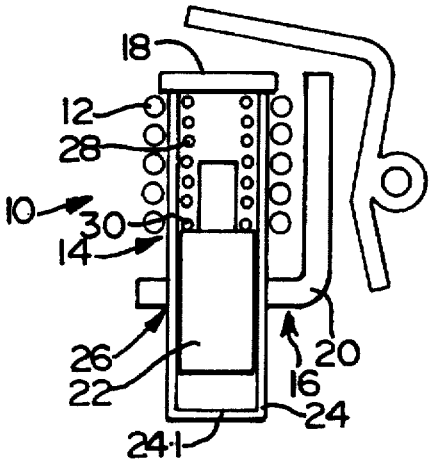
FIG. 2 shows a schematic representation of the device with the coil carrying 100% of the load current.

Referring firstly to FIGS. 1 and 2 of the drawings, an electro-magnetic operating device, in accordance with the invention, for a circuit breaker is illustrated and is designated generally by the reference numeral 10. The device 10 comprises a coil 12 defining a cavity 14 herein. A magnetic path defining means 16 is arranged at least partially around the coil 12. The magnetic path defining means 16 includes a pole piece 18 and a stator frame 20. A displaceable element in the form of a plunger or core 22 is mounted in a tube 24. The tube 24, in turn, is arranged within the cavity 14 defined by the coil 12. Further, the tube 24 protrudes through an opening 26 in the stator frame 20.

One end of the tube 24 is closed off by an end wall 24.1 with an opposed end of the tube 24 being closed off, in a hermetic manner, by the pole piece 18.

To effect time-delayed tripping of a circuit breaker incorporating the device 10, the core 22 is displaceable in a damped manner from the position shown in FIG. 1 of the drawings to a position in which it abuts against the pole piece 18. To effect damped movement of the core 22 within the tube 24, the interior of the tube 24 contains a damping fluid in the form of a liquid of a predetermined viscosity.

The device 10 includes an urging means in the form of a coil spring 28 for urging the core 22 to the position shown in FIG. 1 of the drawings. One end of the coil spring 28 abuts against the pole piece 18 with an opposed end of the coil spring 28 abutting against a shoulder 30 defined in the core 22.

Figure 3:
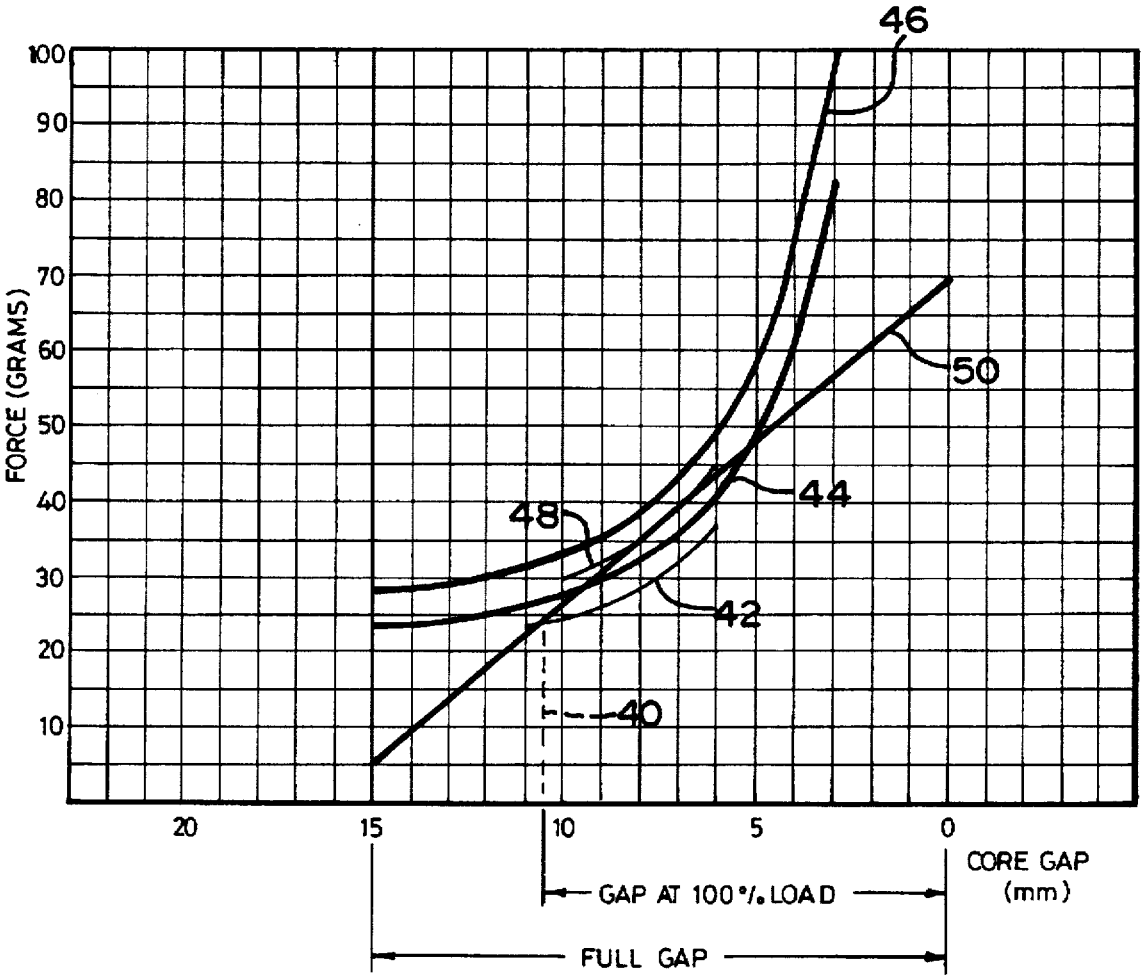
FIG. 3 shows a graphic representation of design criteria for a spring of the device of FIGS. 1 and 2.

Referring now to FIG. 3 of the drawings, the design criteria of the spring 28 are described in greater detail.

Firstly, it is to be noted that the spring 28 is selected such that, when a load current of 100% is present in the coil 12, the electro-magnetic force imparted to the core 22 exceeds, by a predetermined amount, the spring force 28 imparted to the core 22 by the spring 28. Hence, as illustrated in FIG. 2 of the drawings, the core 22 is displaced from its first position to a position intermediate its first position and its second position (where it is an abutment with the pole piece). The spring 28 is, accordingly, selected to have a balancing effect on the core 22 to hold it in equilibrium in the intermediate position shown in FIG. 2 of the drawings and as represented at 40 in FIG. 3 of the drawings.

In FIG. 3 of the drawings, curve 42 shows the core electro-magnetic force characteristic when a load current of 100% is present in the coil 12. Curves 44 and 46 show the minimum trip current, being 105% of the load current, and the maximum trip current, being 115% of the load current, respectively.

The curve 48 shows the core electro-magnetic force characteristic at 110% of load current being present in the coil 12.

In designing the spring, the curves 42 to 48 are plotted on a linear scale and the core spring characteristic is drawn as a line 50 tangential to the core electro-magnetic force corresponding to a nominal operating current of 110%, i.e. the line 50 is plotted tangential to the curve 48. The line 50 is plotted to have the maximum possible slope, which is representative of the maximum spring rate. Where the line 50 intersects the curve 42 (the 100% load current curve) the required spring rate or force is provided.

Figure 4:
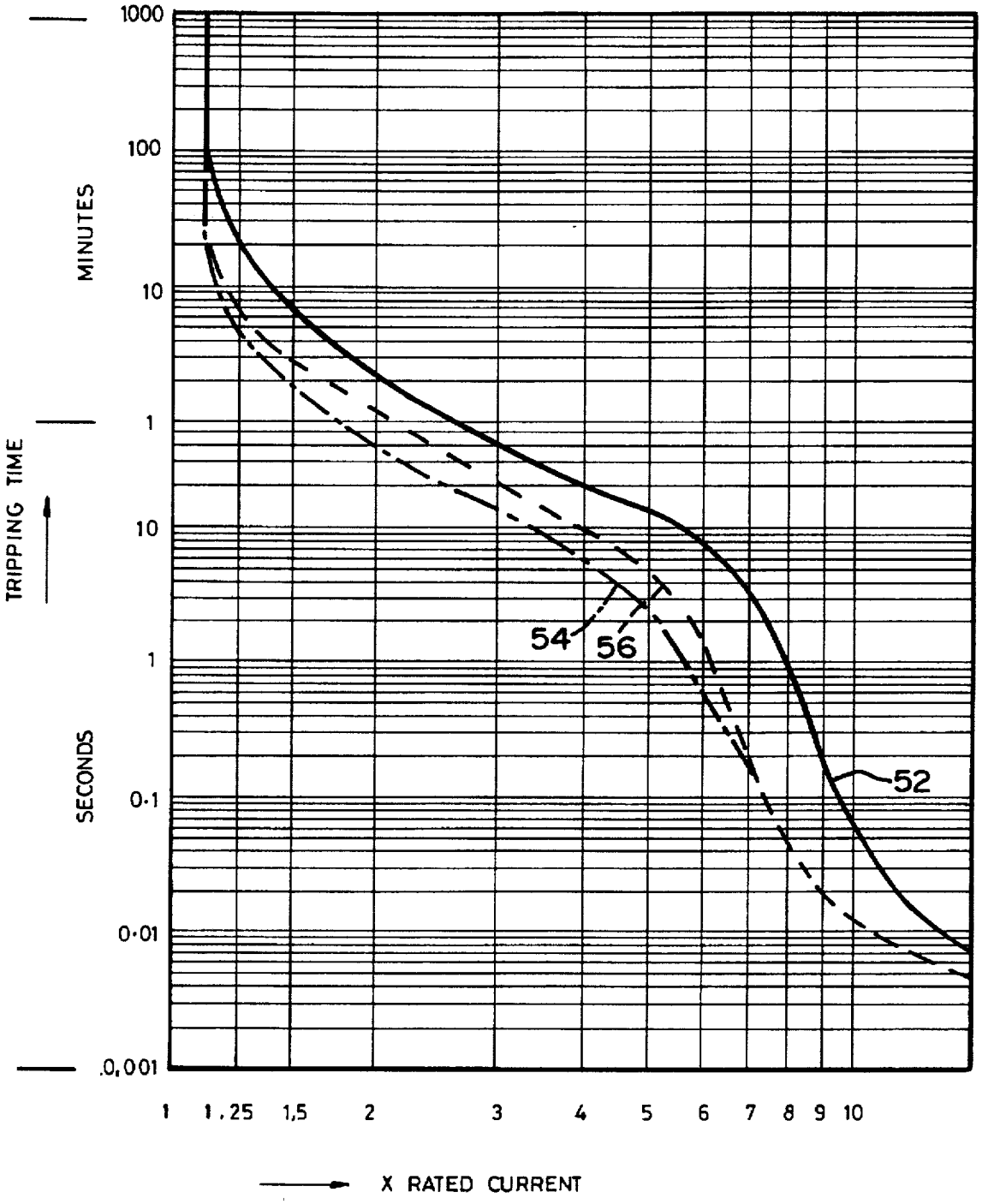
FIG. 4 shows operating curves of the device.

The effect of designing the spring 28 in this manner is shown in FIG. 4 of the drawings. In that figure, curve 52 is representative of the time-delay and instantaneous tripping where the core 22 is in the position shown in FIG. 1 of the drawings, i.e. at load currents less than 100%.

At a load current of 100%, when the core 22 is in the position shown in FIG. 2 of the drawings, when the motor is running hot, the tripping characteristic is given by the curve 54 and, when the motor is running cold, the tripping characteristic is given by the curve 56. Hence, it will be noted that both the delayed tripping time and the instantaneous tripping time are considerably reduced by an appropriate selection of the spring 28.

Heretofore, as far as the applicant is aware, expensive electronic devices have been necessary to provide the required overload protection whilst still allowing high start-up currents.

With the selection of the spring characteristics of the spring 28, as described above, an hydraulic magnetic-type circuit breaker is provided which, when properly matched to the rating of the motor, provides the necessary overload protection. Hence, it is an advantage of the invention that the need for expensive electronic devices for motor protection is obviated.

I claim:

1. An electro-magnetic operating device for a circuit breaker, the device including a coil which defines a cavity therein;

a magnetic path defining means arranged at least partially about the coil, the magnetic path defining means including a pole piece;

a displaceable element arranged within the cavity, the displaceable element being displaceable between a first position, spaced from the pole piece, and a second position, abutting, or in proximity to, the pole piece; and an urging means for urging the displaceable element to its first position, the urging means being selected to have a mechanical force characteristic, so that, at a load current of 100% of an item of electrical equipment connected to the circuit breaker, the urging means balances an electro-magnetic force applied to the displaceable element to hold the displaceable element at a position intermediate its first position and its second position.

2. The device as claimed in claim 1 in which the displaceable element comprises a core.

3. The device as claimed in claim 2 in which the core is slidably mounted in a tube, one end of the tube being closed off by an end wall and an opposed end of the tube being closed off, in a hermetic manner, by the pole piece.

4. The device as claimed in claim 3 in which a damping fluid of a predetermined viscosity is contained within the tube for damping sliding movement of the core.

5. The device as claimed in claim 3 in which the urging means comprises a coil spring, one end of the spring abutting the pole piece and an opposed end of the spring abutting against a predetermined formation of the core.

6. The device as claimed in claim 5 in which a spring force and a spring rate of the spring match the electro-magnetic force applied to the core when the coil carries 100% of load current to hold the core in equilibrium intermediate its first position and its second position.

7. A circuit breaker which includes an electro-magnetic operating device as claimed in claim 1.

* * * * *